United States Patent [19]

Moss et al.

[11] Patent Number: 4,530,137

[45] Date of Patent: Jul. 23, 1985

[54] APPARATUS FOR UNRAVELING KNITTED FABRIC

[76] Inventors: Trevor A. Moss; Roger E. Moss, both of 71 Abbey La., Leicester LE4 5QU, England

[21] Appl. No.: 606,987

[22] Filed: Jun. 29, 1984

Related U.S. Application Data

[63] Continuation of Ser. No. 354,087, filed as PCT GB81/00084, May 11, 1981, published as WO81/03670, Dec. 24, 1981, § 102(e) date Jan. 27, abandoned.

[30] Foreign Application Priority Data

Jun. 17, 1980 [GB] United Kingdom ..... 8019770

[51] Int. Cl.[3] ..... D04B 19/00

[52] U.S. Cl. ..... 28/171; 242/53

[58] Field of Search ..... 28/171, 291; 242/47, 242/53

[56] References Cited

U.S. PATENT DOCUMENTS

| | | | |
|---|---|---|---|
| 1,437,341 | 11/1922 | Dreaper | 28/291 X |
| 2,107,385 | 2/1938 | Moser | 28/171 |
| 2,172,114 | 9/1939 | Tait, Jr. | 28/171 |
| 3,048,343 | 8/1962 | Keith | 242/45 |
| 3,413,700 | 12/1968 | Abowitz | 28/171 |
| 3,419,925 | 1/1969 | Scroggie et al. | 242/53 UX |

FOREIGN PATENT DOCUMENTS

| | | | |
|---|---|---|---|
| 2420625 | 11/1975 | Fed. Rep. of Germany | 242/45 |
| 397598 | 2/1909 | France . | |
| 443293 | 7/1912 | France . | |
| 596481 | 8/1925 | France . | |
| 607958 | 4/1926 | France | 28/171 |
| 628568 | 6/1927 | France . | |
| 692548 | 8/1930 | France . | |
| 1299701 | 6/1962 | France | 28/171 |
| 50-37776 | 12/1975 | Japan | 28/171 |
| 192663 | 2/1923 | United Kingdom | 242/53 |
| 395530 | 1/1974 | U.S.S.R. | 28/171 |
| 742503 | 6/1980 | U.S.S.R. | 28/171 |

*Primary Examiner*—Robert R. Mackey

*Attorney, Agent, or Firm*—Carothers & Carothers

[57] ABSTRACT

The machine comprises means for securing a piece of knitted fabric, pigtail guides for directing ends of yarn from the fabric to a former, a variable speed motor for rotating the former through a countershaft, a belt and a slip clutch. A traverse mechanism comprises a longitudinally movable shaft carrying pigtail guides for winding the yarn uniformly of the former. The formers comprise a number of wire stems projecting a number of wires stems projecting from a hub and having fittings with radial projections to prevent the yarn sloughing off. The countershaft is suspended by the belt.

6 Claims, 5 Drawing Figures

APPARATUS FOR UNRAVELING KNITTED FABRIC

This is a continuation of application Ser. No. 354,087, filed as PCT GB 81/00084 May 11, 1981, published as WO 81/03670, May 11, 1981, published as WO 81/03670, Dec. 24, 1981, § 102(e) date Jan. 27, 1982, now abandoned.

DESCRIPTION

1. Technical Field

The invention relates to machines for unraveling knitted fabric, which are therefore suitable for reclaiming yarn from spoilt garments or from surplus garment parts.

2. The Invention

A machine according to the invention comprises means for securing a piece of knitted fabric, a guide for directing an end of yarn from the fabric to a former, means for rotating the former to draw yarn from the fabric, a slip clutch in the drive for allowing the speed of rotation of the former to adjust to the resistance of the yarn to unraveling, and a variable-speed motor for rotating the former.

Such a machine preferably includes a number of guides for different ends of yarn from the fabric, and an equal number of formers each with its own slip clutch. Each guide is preferably provided with a traverse mechanism so that the yarn winds up uniformly on the former. The guides may be mounted on a shaft which is moved longitudinally to and fro across the width of the former.

The variable-speed motor is preferably a DC shunt-wound motor with a thyristor controller. The motor combines with the slip clutch(es) to allow yarns of different weight and resistance to unraveling to be drawn from the fabric without breakage. Each of the formers can stop rotating when its yarn is not unraveling when not present in the pattern of the fabric actually being unraveled at any time. The unraveling is also assisted by resilience in the formers which allows them to take up energy from the motor and to jerk the yarn after an interruption in the unraveling. In operation, the grip of the slip clutch(es) and the speed setting of the motor are adjusted according to the resistance of the fabric to unraveling.

The formers or swifts are preferably made of wire, and comprise a number of single stems extending radially from a hub. The stems are each preferably made up of a number of sections, each thinner than the last as they extend radially, and made integral by welding, brazing or soldering. The resultant flexibility provides the desired resilience or whip. At least one of the stems is preferably collapsible, more preferably telescopic, and provided with a wing nut to lock the stem at a desired length. Preferably the stems widen at the outer ends to hold a hank of yarn, and are provided with radial projections at the edges to prevent the yarn sloughing off. The stems can also flex in the plane of the swift which helps in the drawing of yarn from the fabric and its winding on the swift.

The drive from the motor to the formers is preferably through a shaft suspended by belts which transmit the drive to slip clutches adjacent the hubs of the formers. The hanging of the shaft makes for simplicity of construction and low maintenance.

A supplementary use to which a machine according to the invention can be put is the splitting of yarns after unraveling. Where a number of ends of yarn have been knitted into a fabric by introduction together through a single feeder, unraveling on a machine according to the invention leads to winding onto a single former. On the former, the yarns tend to be still combined, and require force to separate them. The yarns can be lead off the former together through a yarn guide, and then separated, passed through further guides, and wound onto separate formers. The slip clutches of the formers are adjusted in relation to each other to take account of the extent to which the individual yarns are held together so that the rewinding proceeds smoothly.

DRAWINGS

BEST MODE

The main components of the machine have been indicated particularly in FIGS. 1 and 2 by initial letters as follows:

S—securing means for the fabric;
F—former or swift for unraveled yarn;
C—slip clutch;
M—motor; and
T—traverse mechanism.

Figure 1:
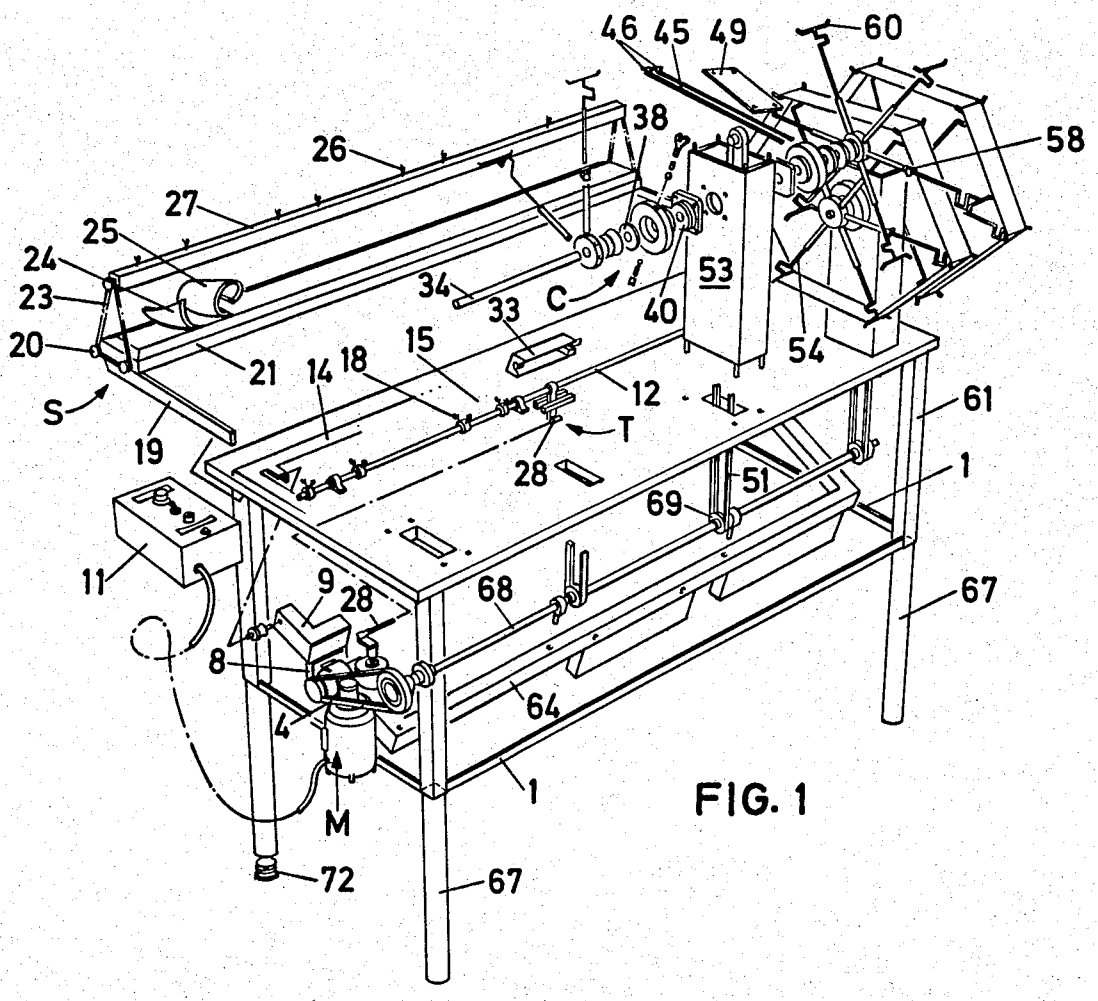
FIG. 1 is a general arrangement of a machine according to the invention in an exploded form with several parts displaced to illustrate the manner of their operation.

These components are mounted on a main frame, the details of which are shown only in FIG. 1:

A table top 15 is secured to a top frame 14 having leg holders 61 projecting downwards. The leg holders 61 are made rigid by leg braces 1, and have legs 67 with feet 72 projecting down to the ground. To the table top 15, there are screwed a number of pedestals 53 of hollow rectangular section each having a top plate 49 secured thereto on studs. The pedestals 53 themselves are often omitted from the drawings in the interests of clarity.

Drive for the machine comes from the motor M which is DC shunt-wound and subject to a thyristor controller 11. The motor M provides means both for rotating the formers F and for moving the traverse mechanism T. The drive to the formers F goes through a gearbox to a belt 4, a countershaft 68, pulleys 69, belts 51, and so up into the pedestals 53. The drive to the traverse mechanism T goes from the motor M through a worm gearbox 2, to a crank 7, and thence through a link 28, a ball joint 29, and arm 30 between wear strips 31 to a shaft 12. The shaft 12 is movable longitudinally to and fro, transversely with respect to the formers F, and is mounted on the table top 15 between plummer blocks 16. The shaft 12 carries pigtail guides 18 for the yarn. To the table top 15, there is screwed a cover 33 (FIG. 1) for the upper end of the arm 30 and its union with the shaft 12. The traverse mechanism T is perhaps best shown in FIG. 2, because in FIG. 1 the link 28 is divided to illustrate its operation.

The countershaft 68 which conveys the drive from the motor M to the formers F is mounted in plummer blocks 71 secured to a cross member 64 of a movable lower frame. The lower frame consists also of side bars 63 pivotally secured through rubber mountings 10 to fixing plates 13 projecting from the top frame 14 of the machine. The lower frame is suspended by the belts 51 from the pedestals 53, and hangs down with the assistance of weights 65 against the resilience of the rubber mountings 10. The lower frame has a bracket 9 carrying a hinge 8, to which the motor M is secured ensuring reasonable tension in the belt 4. This arrangement is perhaps best shown in FIG. 2, as in FIG. 1 the lower frame has been displaced at the mountings 10 for clarity of illustration.

Figures 2, 2A:
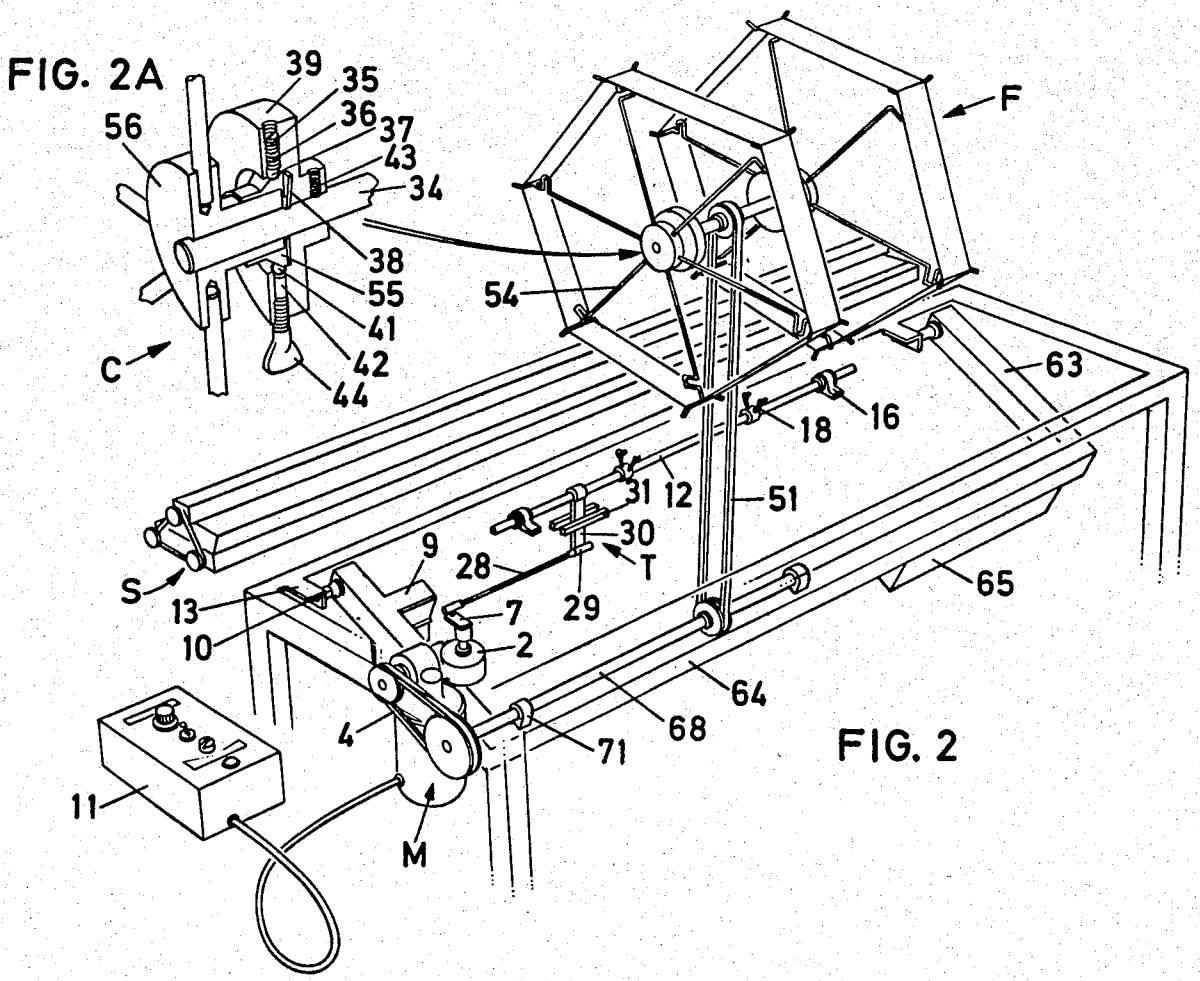
FIG. 2 is a schematic perspective view similar to FIG. 1, with many parts omitted in order to emphasize those shown.
FIG. 2A is a sectional perspective view through the slip clutch and thus is shown inset in FIG. 2.

The slip clutches C between the belts 51 and the formers F are mounted on spindles 34 as best shown in FIG. 2A. A clutch housing 39 is held fast on the spindle 34 by a grub screw 43. Inside the clutch housing 39 is a bearing holder 55 (FIG. 2A) which is fast on a nylon hub 56 of a former F. The bearing holder 55 has a conical face contacting ball bearings 37 and 41. The ball bearing 37 is held in contact with the holder 55 by a spring 36 and a grub screw 35. The ball bearing 42 is similarly secured by a piece of rubber cord 42 and a thumbscrew 44. The pressure of the ball bearings 37,41 on the holder 55 can be varied by an operator by adjustment of the position of the grub screw 35, and more easily of the thumbscrew 44 respectively, so as to alter the pressure of the bearing holder 55 on a nylon friction disc 38 between the holder 55 and the housing 39. In practice, this pressure is adjusted to take account of the resistance of the yarn to unraveling from the fabric The spindle 34 is mounted with respect to the pedestal 53 by a plummer block 40 on each side of the pedestal as shown in FIG. 1.

The formers F each comprise a number of wire stems 54 projecting from the hub 56. As accurately shown in FIG. 1 (but not in FIG. 2), the stems 54 are each made up of a number of sections, each thinner than the last as they extend radially, and made integral by brazing. One of the stems 54 of each former is provided with a wing nut 58 (FIG. 1) whereby the length of the stem 54 can be locked in any desired position and a hank of yarn can accordingly be removed from the former F. Near the outer ends, the stems 54 are each deformed laterally to increase flexibility, and at the end they have fittings 60 provided with radial projections at the edges to prevent the yarn from sloughing off.

Figure 3:
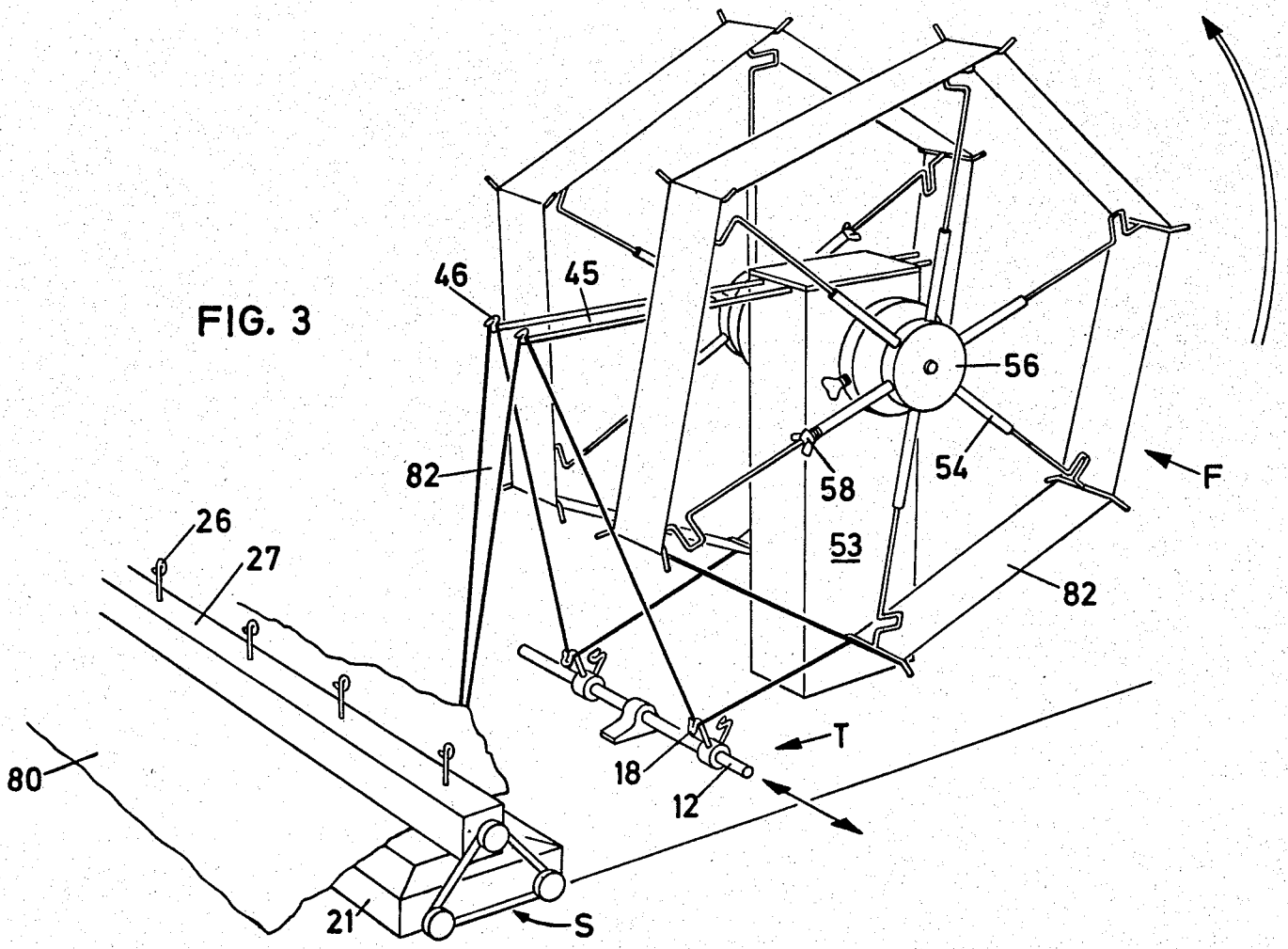
FIG. 3 shows parts as in the preceding Figures in order to clarify the method of operation.

The securing means S for a piece of knitted fabric is also best illustrated in FIG. 1. A fabric holder bracket 19 projects from the top frame 14 of the machine, and bears a main beam 21 along the whole length of the machine. On the upper surface of the beam 21, there is mounted an underlay 24 and a carpet 25. Fabric 80 (FIG. 3) for unraveling is secured to the upper surface of the carpet 25 by means of a lock bar 27 under pressure from a rubber lock belt 23 at each end engaging with lock bushes 20.

EXPLOITATION

Yarn 82 (FIG. 3) is drawn off from the fabric 80 through pigtail guides 46 mounted on the ends of tension rods 45 projecting from the pedestals 53, and then passes through pigtail guides 18 secured to the shaft 12 of the traverse mechanism T and thence onto the formers F. Depending upon the resistance to unraveling of any particular yarn 82 coming from any particular fabric 80, the path of the yarn 82 may be varied either so as to omit the pigtail guides 46 and pass directly through the pigtail guides 18, or to pass through a pair of adjacent guides 18 after an intermediate passage through the guides 46.

Figure 4:
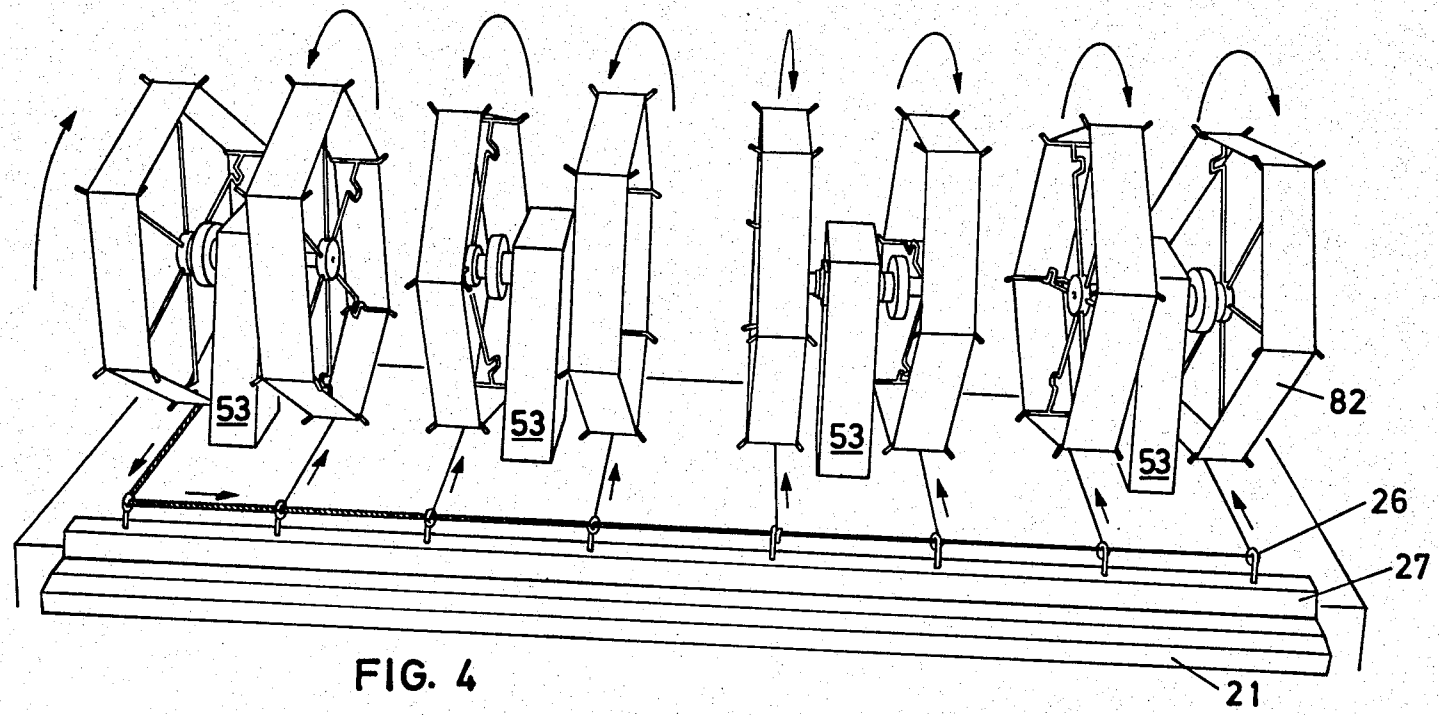
FIG. 4 is similar but illustrates the manner of operation for splitting yarns which have already been unraveled.

The splitting of yarns after unraveling is illustrated in FIG. 4. A single hank of yarn coming from a former F is mounted on the former at the left hand end of the machine, and locked in position after loosening its slip clutch C. The yarn is drawn off through the pigtail guides 26 on the lock bar 27 of the securing means S. Different individual yarns are led to all the other formers on the machine. By rotating the different formers in the directions indicated by the arrows, the yarn can be split and its components wound onto different formers F.

We claim:

1. A machine for unraveling knitted fabric which comprises means for securing a piece of knitted fabric, a guide for directing an end of yarn from the fabric, a flexible former for receiving the yarn from the guide, a spindle rotatably mounting the former, an adjustable slip clutch between the former and the spindle, a drive to the former through the slip clutch, a variable speed motor for rotating the former through the drive, means for adjusting the clutch to allow the speed of rotation of the former to adapt to the resistance of the yarn to unraveling, the drive from the motor to the former comprising a substantially horizontal shaft driven by the motor and means supporting the shaft for vertical movement, the shaft being vertically suspended by a belt which transmits the drive to the slip clutch.

2. A machine for unraveling knitted fabric which comprises means for securing a piece of knitted fabric, a guide for directing an end of yarn from the fabric, a flexible former for receiving the yarn from the guide, a spindle rotatably mounting the former, an adjustable slip clutch between the former and the spindle, the slip clutch comprising a housing secured to a selected one of the spindle and former and a clutch member secured to the other of the spindle and former, means for adjusting frictional engagement between the clutch member and the housing, a drive to the former through the slip clutch, a variable-speed motor for rotating the former through the drive, and means for adjusting the speed of the variable-speed motor and the means for adjusting the clutch to allow the speed of rotation of the former to adapt to the resistance of the yarn to unraveling, the drive from the motor to the former comprising a substantially horizontal shaft driven by the motor and means supporting the shaft for vertical movement, the shaft being vertically suspended by a belt which transmits the drive to the slip clutch.

3. A machine according to claim 2 in which the slip clutch comprises a nylon friction disc between the clutch member and the housing.

4. A machine according to claim 2 in which the means for adjusting frictional engagement between the clutch member and the housing comprises a ball bearing engaging a coincal face of the clutch member and means in the housing for urging the ball bearing towards the clutch member.

5. A machine according to claim 4 in which the means in the housing comprises a spring bearing on a screw.

6. A machine according to claim 5 in which the means in the housing comprises also a piece of rubber cord.

* * * * *